US006017297A

United States Patent [19]

Collins

[11] Patent Number: 6,017,297

[45] Date of Patent: Jan. 25, 2000

[54] BALANCE BOARD

[76] Inventor: Brian T. Collins, 7000 Beach Dr. E., Port Orchard, Wash. 98366

[21] Appl. No.: 09/131,869

[22] Filed: Aug. 10, 1998

[51] Int. Cl.[7] ..... A63B 7/08

[52] U.S. Cl. ..... 482/146; 482/147

[58] Field of Search ..... 482/34, 146, 147, 482/79, 80; 273/440; 280/87.041, 87.042; 472/13, 114, 110, 128

[56] References Cited

U.S. PATENT DOCUMENTS

| | | | |
|---|---|---|---|
| 3,895,794 | 7/1975 | England . | |
| 4,505,477 | 3/1985 | Wilkinson | 272/146 |
| 4,601,469 | 7/1986 | Sasser, Jr. | 272/146 |
| 4,911,440 | 3/1990 | Hyman et al. | 272/146 |
| 5,152,691 | 10/1992 | Moscarello | 434/247 |
| 5,190,506 | 3/1993 | Zubik et al. | 482/68 |
| 5,545,115 | 8/1996 | Corcoran | 482/146 |

*Primary Examiner*—Jerome W. Donnelly
*Assistant Examiner*—Jayne Saydah
*Attorney, Agent, or Firm*—David L. Davis

[57] ABSTRACT

A balance board having a deck and a pair of parallel spaced rails supported on the deck. An underlying roller is rotatably mounted to a carriage having a pair of spaced wheel assemblies which rollingly engage respective ones of the rails. The roller engages the underside of the deck when the wheel assemblies engage the rails, and may be tapered to allow multi-directional use of the board.

10 Claims, 3 Drawing Sheets

BALANCE BOARD

BACKGROUND OF THE INVENTION

This invention relates to a balance board of the type having a foot-supporting deck in contact with an underlying roller positioned between the deck and the ground and, more particularly, to an improved balance board of the type described which includes structure for maintaining the roller in contact with the deck.

In using a balance board of the type described, the user stands on the deck with his feet apart and with the roller positioned under the deck and in contact with the deck and the ground. The deck is usually elongated with opposed ends defining a longitudinal axis therebetween. The roller is typically cylindrical and held in some manner so that the axis of the roller remains perpendicular to the longitudinal axis of the deck. When the user stands on the deck, his feet are generally perpendicular to the longitudinal axis of the deck and are spaced along a line which is parallel to the longitudinal axis. The roller is positioned below the deck between the user's feet and the user rocks his body from side to side to maintain his balance.

To allow the user to move and change direction, it is also known to provide a roller which is tapered from a major central diameter to a smaller diameter at its ends. The user can pitch his body from front to back to tilt the deck about its longitudinal axis to cause smaller diameter portions of the roller to contact the ground, with the major diameter remaining in contact with the deck, so that the board partakes of arcuate travel.

All of the known prior art balance boards of the type described are disadvantageous in that they do not adequately maintain the roller in contact with the underside of the deck as the roller travels along the length of the deck. It would therefore be desirable to have a balance board of the type described which includes structure for maintaining the roller in contact with the underside of the deck along the entire length of travel of the roller, even during radical maneuvers of the board.

It would also be desirable to have such a balance board wherein the roller is tapered so that the user can change direction when moving on the board.

SUMMARY OF THE INVENTION

According to the present invention, there is provided a balance board comprising an elongated deck having a generally planar upper foot supporting surface and a generally planar lower surface parallel to and spaced from the upper surface. The deck has a pair of opposed ends defining a longitudinal axis therebetween, and a pair of parallel spaced rails are supported on the deck extending parallel to the longitudinal axis of the deck. A carriage having a pair of spaced wheel assemblies is provided, wherein each of the pair of wheel assemblies includes at least one wheel adapted to rollingly engage a respective one of the pair of rails. A roller has an axial bore extending between its ends and an axle extends through the roller bore. The axle is mounted to the carriage so that it is orthogonal to the longitudinal axis of the deck when the carriage wheels engage the rails. The structural elements of the board are dimensioned so that the roller engages the lower surface of the deck when the carriage wheels engage the rails.

In accordance with an aspect of this invention, the roller has its greatest diameter centrally between its ends and tapers inwardly from the greatest diameter toward the ends, and the portion of the roller having the greatest diameter engages the lower surface of the deck when the carriage wheels engage the rails.

In accordance with another aspect of this invention, each of the pair of rails comprises a first elongated planar bar secured to a side of the deck between the upper and lower surfaces with the plane of the first bar being parallel to the upper surface, and a second elongated planar bar secured to that side of the deck between the upper and lower surfaces with the plane of the second bar being orthogonal to the upper surface. Each of the pair of wheel assemblies includes a pair of first wheels supported for rotation each about a respective one of a pair of spaced first axes parallel to the roller axial bore, and a pair of second wheels supported for rotation each about a respective one of a pair of spaced second axes orthogonal to the upper surface. Each of the pair of first wheels is adapted to rollingly engage the first bar and each of the pair of second wheels is adapted to rollingly engage the second bar.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 2:
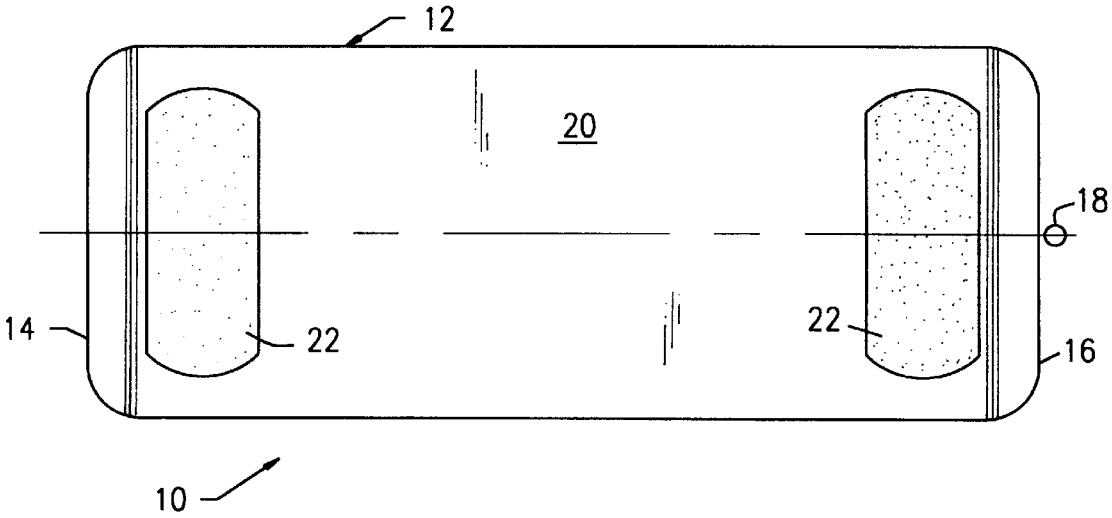
FIG. 2 is a top plan view of the balance board shown in FIG. 1.

Referring to the drawings, shown therein is a balance board, designated generally by the reference numeral 10 and constructed according to the principles of the present invention. The board 10 includes an elongated deck (or platform) 12 having opposed ends 14, 16 defining a longitudinal axis 18 therebetween. While the following discussion uses the term "generally planar" to describe several surfaces, it is understood that this term is meant to include a surface having a slight arc, either convex or concave, along the longitudinal axis. In plan view (FIG. 2), the deck 12 is generally rectangular, illustratively with rounded corners, and may be approximately 27" by 12". The deck 12 has an upper surface 20 which is generally planar over a substantial portion of the surface 20 and illustratively is slightly upturned toward its opposed ends 14, 16. If desired, a pair of frictional foot pads 22 may be provided on the upper surface 20 inwardly from the opposed ends 14, 16 and on the flat portion of the upper surface 20. Alternatively, a large portion of the upper surface 20, or the entire upper surface 20, may be formed as, or be covered with, a surface having a high coefficient of friction.

Figure 1:
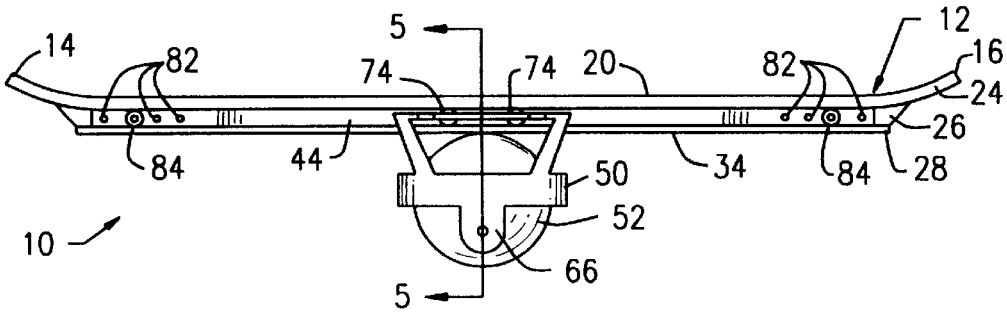
FIG. 1 is a side view of an exemplary balance board constructed according to the present invention.
Figure 5:
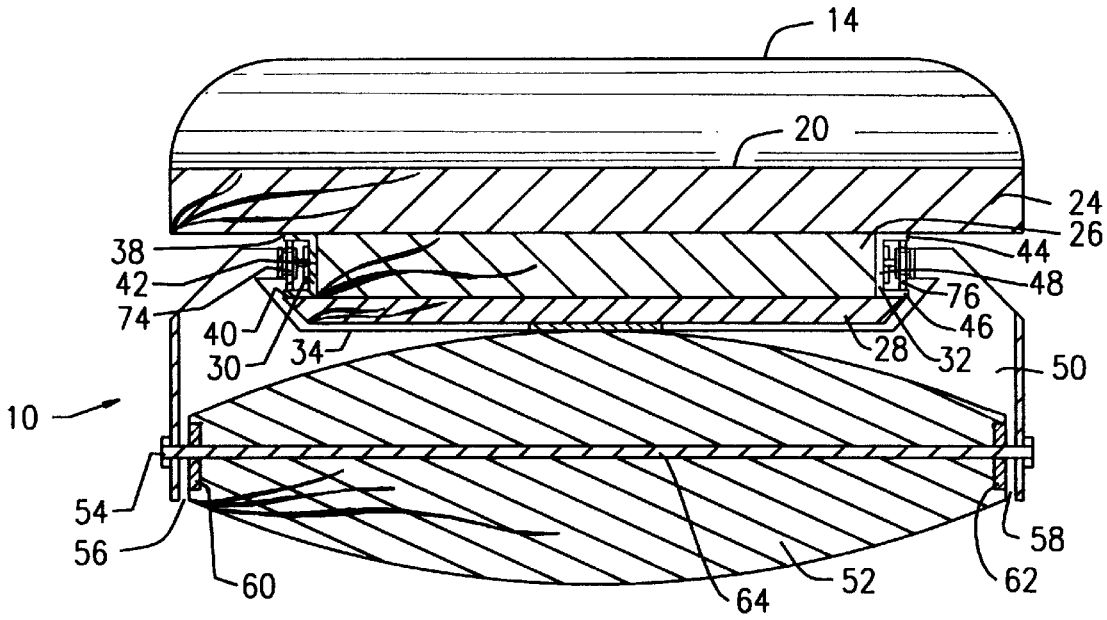
FIG. 5 is a cross sectional view taken along the line 5—5 in FIG. 1.
Figure 6:
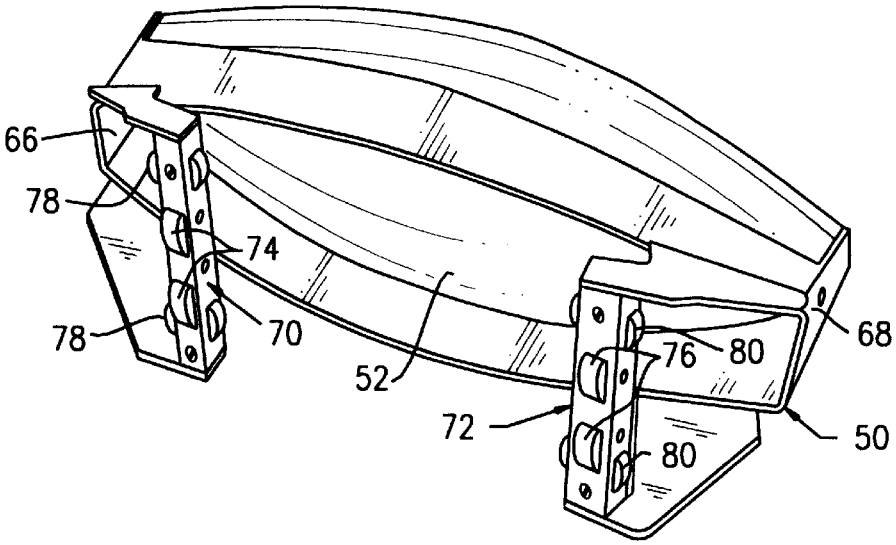
FIG. 6 is a perspective view showing the carriage and roller assembly of the board shown in FIG. 1.

As best shown in FIG. 5, the deck 12 illustratively comprises three pieces, which may be formed of wood, metal, plastic, fiberglass or other suitable material or composite. The upper surface 20 and the opposed ends 14, 16 may be formed from a board 24, such as a plywood board, which is suitable bent at its opposed ends 14, 16 to provide the upward curves shown in FIG. 1. Below the upper board 24 is a spacer board 26 which is generally rectangular in plan and smaller in dimension than the upper board 24. Illustratively, the spacer board 26 is flat, as is the lower board 28. Alternatively, the boards 26, 28 may have a slight arc longitudinally. The lower board 28 is larger in dimension than the spacer board 26 but smaller in dimension than the upper board 24. Thus, the deck 12 is formed as a sandwich of the boards 24, 26, 28, which may be secured to each other in any suitable fashion, such as by adhesive or screws. The relative dimensions of the boards 24, 26, 28 are such that a pair of parallel channels 30, 32 are formed which are defined by the edges of the spacer board 26, the lower surface of the upper board 24, and the upper surface of the lower board 28. The channels 30, 32 extend parallel to the longitudinal axis 18.

Figure 3:
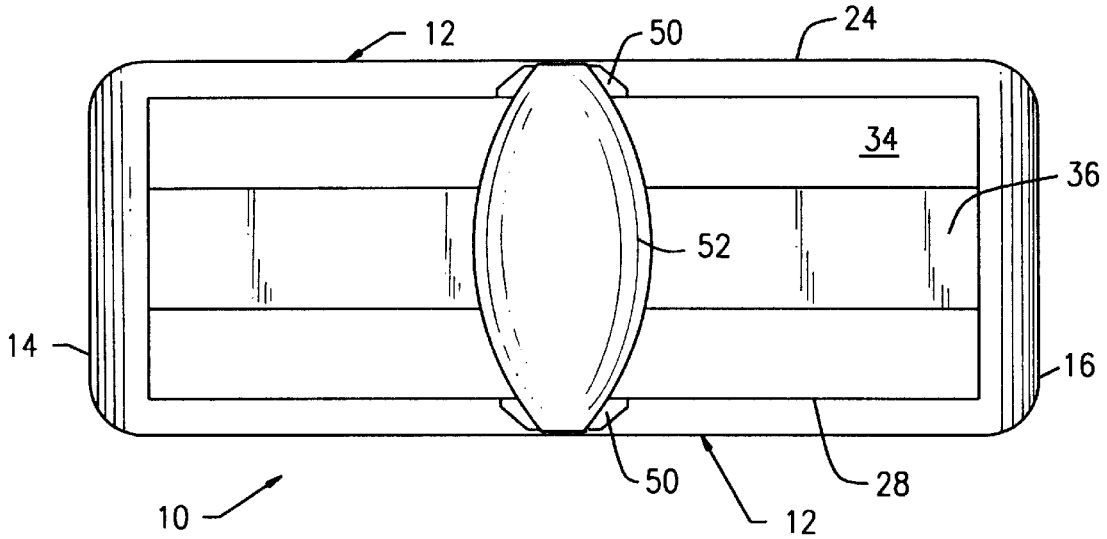
FIG. 3 is a bottom plan view of the balance board shown in FIG. 1.
Figure 4:
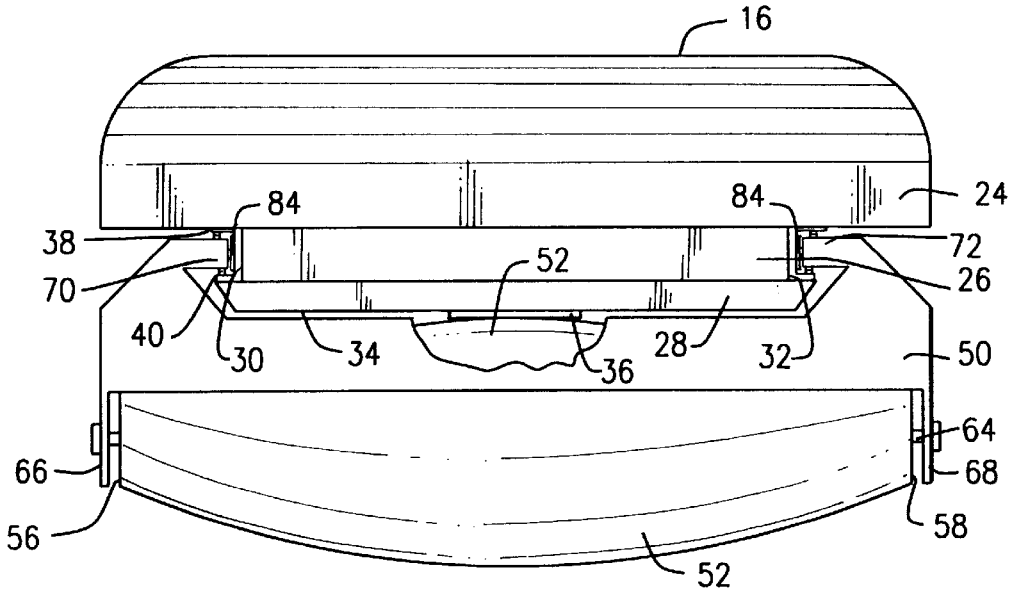
FIG. 4 is an end view of the balance board shown in FIG. 1.

The lower surface 34 of the lower board 28 is generally planar and is parallel to and spaced from the upper surface 20. If desired, a strip 36 of friction providing material may be adhered to the lower surface 34, having its length extending parallel to the longitudinal axis 18 and being as long as the lower board 28, as best shown in FIG. 3.

Although the deck 12 has been described as being formed of three separate wood boards 24, 26, 28, it will be appreciated that it may be formed from a single piece of wood, two pieces of wood, or may be molded either unitarily or separately from a plastic material. Other constructions and materials for the deck 12 will be apparent to one of skill in the art.

Mounted to the deck 12 between the upper surface 20 and the lower surface 34, are a pair of parallel spaced rails extending parallel to the axis 18. Illustratively, the rails are each mounted in a respective one of the channels 30, 32. Illustratively, the rail mounted in the channel 30 includes an elongated planar bar 38 parallel to the upper surface 20, an elongated planar bar 40 parallel to the upper surface 20 and an elongated planar bar 42 orthogonal to the upper surface 20. Similarly, the rail mounted in the channel 32 includes an elongated planar bar 44 parallel to the upper surface 20, an elongated planar bar 46 parallel to the upper surface 20, and an elongated planar bar 48 orthogonal to the upper surface 20. Illustratively, the rail comprising the bars 38, 40, 42 may be formed of a unitary metal planar bar bent into a C-shaped cross section, as may the rail comprising the bars 44, 46, 48.

The board 10 further includes a carriage 50 to which is mounted a roller 52. As shown, the roller 52 has a central axial bore 54 extending between its ends 56, 58. Preferably, the roller 52 is tapered, having its greatest diameter centrally between its ends 56, 58 and tapering inwardly from that greatest diameter toward the ends 56, 58. The roller 52 is preferably formed of, or surfaced with, a rubber-plastic material or other suitable material that has a suitable coefficient of friction to rollingly engage the underside of the board without sliding therealong. Although the roller 52 is shown as being tapered along a continuous arc, various modifications are possible. Thus, the taper of the roller 52 can be a constant arc or alternatively can be a variable arc. Further, the taper of the roller 52 can be discontinuous or continuous. Illustratively, the greatest diameter of the roller 52 is about six inches, and its length is slightly less than the width of the deck 12.

The bore 54 preferably is enlarged adjacent the ends 56, 58 so that bearings 60, 62 can be installed. An axle 64 is installed through the bearings 60, 62 and the bore 54, with end portions extending outwardly beyond the ends 56, 58 of the roller 52.

The carriage 50 illustratively may be formed of sheet metal which is bent, folded and welded so that it has two mounting portions 66, 68 flanking the roller 52 and each having an opening to allow the axle 64 to pass therethrough and be secured thereto, in a conventional manner. Thus, the roller 52 is secured for rotation to the carriage 50. Alternatively, the carriage 50 may be formed of any other suitable material (such as carbon graphite or plastic, for example) which can be cast into the appropriate shape.

The carriage 50 further includes a pair of spaced wheel assemblies 70, 72. The wheel assembly 70 is adapted to rollingly engage the rail including the bars 38, 40, 42 and the wheel assembly 72 is adapted to rollingly engage the rail assembly including the bars 44, 46, 48. Illustratively, the wheel assembly 70 includes a pair of first wheels 74 supported for rotation each about a respective one of a pair of spaced first axes parallel to the roller axial bore 54. Similarly, the wheel assembly 72 includes a pair of first wheels 76 supported for rotation each about a respective one of a pair of spaced first axes parallel to the roller axial bore 54. The wheels 74 are adapted to rollingly engage one or the other of the bars 38, 40 and the wheels 76 are adapted to rollingly engage one or the other of the bars 44, 46. Further, the wheel assembly 70 includes a pair of second wheels 78 supported for rotation each about a respective one of a pair of spaced second axes orthogonal to the upper surface 20 and the wheel assembly 72 similarly includes a pair of second wheels 80 supported for rotation each about a respective one of a pair of spaced second axes orthogonal to the upper surface 20. Thus, the wheels 78 are adapted to rollingly engage the bar 42 and the wheels 80 are adapted to rollingly engage the bar 48.

The ends of the rail assemblies are open so that the carriage 50 can be installed from an end of the board 10. The dimensions of the carriage 50 are such that when the carriage is installed along the rails, the central portion of the roller 52 having the greatest diameter engages the lower surface 34 of the deck 12. (As discussed above, this portion of the lower surface 34 may have friction providing material 36 therealong.) The wheel assemblies 70, 72 are captured in their respective rail assemblies so that the roller 52 is maintained in contact with the lower surface 34 of the board 10.

To limit the travel of the carriage 50 longitudinally along the deck 12, the bars 42, 48 are formed with openings 82 spaced therealong. Stop members 84 may be secured to the board 10 on both sides of the deck 12 and at both ends of the rails in selected openings 82. The stop members 84 interfere with the carriage 50 to limit its range of travel.

By using a tapered roller 52, a user of the balance board 10 can change the direction of the board 10 by pitching forward or back to change the point of contact on the roller 52 with the ground surface.

Accordingly, there has been disclosed an improved balance board. While an exemplary embodiment has been disclosed herein, it is understood that various modifications and adaptations to that embodiment will be apparent to one of ordinary skill in the art and it is intended that this invention be limited only by the scope of the appended claims.

What is claimed is:

1. A balance board comprising:

an elongated deck having a generally planar upper foot supporting surface and a generally planar lower surface parallel to and spaced from said upper surface, said deck having a pair of opposed ends defining a longitudinal axis therebetween;

a pair of parallel spaced rails supported on said deck and extending parallel to said longitudinal axis;

a carriage having a pair of spaced wheel assemblies, each of said pair of wheel assemblies includes at least one wheel adapted to rollingly engage a respective one of said pair of rails;

a roller having a central axial bore extending between its ends; and an axle extending through said roller bore and mounted to said mounting portions so that said axle is orthogonal to said longitudinal axis when said carriage wheels engage said rails;

wherein said roller engages the lower surface of said deck when said carriage wheels engage said rails.

2. The board according to claim 1 wherein:

each of said pair of rails comprises an elongated planar bar secured to a side of said deck between said upper and lower surfaces, the plane of said bar being parallel to said upper surface; and each of said pair of wheel assemblies includes a wheel supported for rotation about an axis parallel to said roller axial bore.

3. The board according to claim 1 wherein:

each of said pair of rails comprises an elongated planar bar secured to a side of said deck between said upper and lower surfaces, the plane of said bar being orthogonal to said upper surface; and each of said pair of wheel assemblies includes a wheel supported for rotation about an axis orthogonal to said upper surface.

4. The board according to claim 1 wherein:

each of said pair of rails comprises a first elongated planar bar secured to a side of said deck between said upper and lower surfaces with the plane of said first bar being parallel to said upper surface, and a second elongated planar bar secured to said side of said deck between said upper and lower surfaces with the plane of said second bar being orthogonal to said upper surface; and each of said pair of wheel assemblies includes a first wheel supported for rotation about a first axis parallel to said roller axial bore and a second wheel supported for rotation about a second axis orthogonal to said upper surface;

wherein said first wheel is adapted to rollingly engage said first bar and said second wheel is adapted to rollingly engage said second bar.

5. The board according to claim 1 further comprising:

a pair of stop members associated with each of said pair of rails, said stop members being secured to the associated rail at spaced locations thereon on opposite sides of the wheel engaging the associated rail and interfering with carriage to limit the travel of said carriage along said pair of rails.

6. The board according to claim 5 wherein:

each of said pair of rails is formed with a plurality of spaced openings each adapted to securingly engage a stop member therein; and said stop members are movable along said pair of rails to be secured in respective selected ones of said openings to selectively vary the travel limit of said carriage.

7. The board according to claim 1 further comprising a layer of friction-providing material on said lower deck surface for engagement by said roller.

8. The board according to claim 1 wherein each of said pair of wheel assemblies comprises a pair of spaced wheels supported for rotation each about a respective one of a pair of spaced parallel axes.

9. The board according to claim 1 wherein:

each of said pair of rails comprises a first elongated planar bar secured to a side of said deck between said upper and lower surfaces with the plane of said first bar being parallel to said upper surface, and a second elongated planar bar secured to said side of said deck between said upper and lower surfaces with the plane of said second bar being orthogonal to said upper surface; and each of said pair of wheel assemblies includes a pair of first wheels supported for rotation each about a respective one of a pair of spaced first axes parallel to said roller axial bore, and a pair of second wheels supported for rotation each about a respective one of a pair of spaced second axes orthogonal to said upper surface;

wherein each of said pair of first wheels is adapted to rollingly engage said first bar and each of said pair of second wheels is adapted to rollingly engage said second bar.

10. The board according to claim 1 wherein:

said roller has its greatest diameter centrally between its ends and tapers inwardly from said greatest diameter toward said ends; and the portion of said roller having said greatest diameter engages said lower surface of said deck when said carriage wheels engage said rails.

* * * * *